US005557858A

United States Patent [19]

Macaluso et al.

[11] Patent Number: 5,557,858

[45] Date of Patent: Sep. 24, 1996

[54] INFRARED WOOD PRODUCT DRYER

[75] Inventors: Virgil Macaluso; Abdel-Jaber A. Hamad; Dewey Marshall, all of Independence, Kans.

[73] Assignee: Catalytic Industrial Group Inc., Independence, Kans.

[21] Appl. No.: 519,845

[22] Filed: Aug. 25, 1995

[51] Int. Cl.[6] ..... F26B 3/34

[52] U.S. Cl. ..... 34/273; 34/420; 34/203; 34/205; 34/208; 34/210

[58] Field of Search ..... 34/266, 273–74, 34/203, 205, 208, 210, 216–17, 419–20

[56] References Cited

U.S. PATENT DOCUMENTS

| | | | |
|---|---|---|---|
| 2,428,090 | 5/1944 | Naeher et al. | 34/266 |
| 5,038,498 | 8/1991 | Woosley | 34/203 |

*Primary Examiner*—John M. Sollecito
*Assistant Examiner*—Steve Gravini
*Attorney, Agent, or Firm*—Hovey, Williams, Timmons & Collins

[57] ABSTRACT

An infrared wood product dryer apparatus (10) constructed in accordance with the invention broadly includes enclosure structure (12) defining an interior (20), a conveyor assembly (14) configured for conveying a particulate material along a material flow path through the interior (20) substantially between an inlet (22) and an outlet (24), an array of infrared radiant energy sources (22) configured for exposing the material to infrared radiant energy while it is conveyed along the path (38), and a series of agitators (18) configured for agitating the material in order to increase the exposure of the material to the infrared radiant energy. A gas recirculation assembly (52) is provided to direct a heated interior gas onto the material in order to convection-dry the material. An exhaust assembly (62) reduces the moisture content of the interior gas by drawing a quantity of the gas from the dryer (10) so that fresh gas having a lower moisture content may be drawn into the dryer (10). A method of drying a particulate cellulosic material includes conveying the material along a material flow path, exposing the material to infrared radiant energy during the conveyance along the path, and agitating the material during the conveyance along the path.

17 Claims, 2 Drawing Sheets

INFRARED WOOD PRODUCT DRYER

BACKGROUND OF THE INVENTION

1. Field of the Invention

The present invention relates to dryer devices used to reduce the moisture content of particulates, e.g. cellulosic materials such as sawdust and wood chips, while conveying the material along a material flow path from an inlet to an outlet. More particularly, the invention pertains to a dryer apparatus and a method which exposes the material to infrared radiant energy during the conveyance through the dryer, and agitates the material to increase the exposure of the material to the infrared radiant energy.

2. Description of the Prior Art

Composition boards, such as particle board, chipboard, and medium density fiberboard (MDF), are increasingly important to many segments of the wood construction industry, such as the furniture industry. In part, this is due to the relatively high strength and low manufacturing costs associated with composition boards compared with regular hardwood and softwood boards.

Materials which are used in the manufacture of composition boards include particulate cellulosic materials, such as wood chips, and sawdust, and the like. These materials often have an initial moisture content which exceeds 50%. Since the moisture content of the materials should ideally be about 10–12% before they are used to create composition board, the materials must be dried.

Presently, particulate cellulosic materials are convection-dried by being mixed with a heated gas. The energy of the heated gas is absorbed at the surface of the material and acts to evaporate the moisture.

One known convection-based drying method involves injecting a mixture of heated gas and material into a multiple-pass rotary drum dryer. Generally, such a convection-based dryer device includes an arrangement of several concentric tubes, each tube having an open end, an inlet adjacent to the largest tube, and an outlet adjacent to the smallest tube. The tubes define a serpentine material flow path, allowing the mixture to pass through the length of each tube and into the next smaller tube until the mixture is ejected through the outlet. Once the mixture reaches the outlet, it is sufficiently dry for use.

In order to dry the material in convection-based dryers, such as rotary drum dryer devices, the gas must be heated to a relatively high temperature, usually more than 600° F., prior to injection. Heating the gas to these temperatures, however, is relatively expensive and inefficient. The heated gas may also lead to scorching of the material, causing damage to the material, as well as creating a fire hazard.

Since heated gas dries the material at its surface, the moisture must be drawn to the surface to be evaporated. As a result, convection drying is a relatively slow process, requiring the use of a dryer having a relatively long material flow path. Additionally, U.S. Pat. No. 4,146,973 issued to Steffensen et al. discloses that convection drying has a tendency to develop a boundary layer of saturated vapor at the surface of the material, further inhibiting the drying of the material.

Therefore, a significant, and heretofore unsolved, need exists to provide a dryer which more rapidly and efficiently dries particulate cellulosic materials, such as sawdust, and wood chips. There also exists a need to reduce the likelihood of scorching or otherwise damaging the material as it is dried.

SUMMARY OF THE INVENTION

The present invention addresses the prior art problems discussed above, and provides a distinct advance in the state of the art. More particularly, the infrared wood product dryer hereof includes a source of infrared radiant energy which exposes the particulate material to infrared radiant energy in order to dry the material, while reducing the likelihood of causing damage to the material.

The infrared wood product dryer broadly includes structure defining an enclosure presenting an interior, and a conveying means for conveying a particulate material along a material flow path through the interior substantially between an inlet and an outlet. The dryer also includes a means for exposing the material to infrared radiant energy while it is conveyed along the path, and an agitating means for agitating the material to increase the exposure of the material to the infrared radiant energy. In order to assist in drying the material, the dryer may include a convection means for directing a heated gas onto the material, and an exhaust means for exhausting a quantity of a vapor released by the material.

Infrared (IR) radiant energy offers several advantages over the convection-based dryers discussed above. As an example, the emission of IR radiant energy is close to the absorption spectrum of cellulose material. Therefore, the energy is absorbed into the material, acting to heat the material from the inside. The emission is also close to the absorption spectrum of water, and thus water is readily heated by IR radiant energy. Additionally, as cellulose materials are heated by IR radiant energy, the boundary layer of saturated vapor associated with the prior art devices is not produced. As a result of these factors, IR radiant energy dries cellulose materials more rapidly than convection-based dryers.

The energy requirements associated with producing IR radiant energy used in drying cellulose materials are less than the energy required to dry the same materials using heated gas. Therefore, IR radiant energy offers a higher system efficiency than convection-based dryers.

In a preferred form, the conveying means includes a conveyor assembly having a plurality of superposed conveyor belts. Each belt defines a separate material flow path level, and adjacent ones of the conveyor belts are configured to convey the material in opposite directions so that the material path is substantially serpentine. The inlet is adjacent to an upper one of the conveyor belts, while the outlet is adjacent to a lower one of the belts. A conveyor belt may be provided adjacent to the outlet to convey the dried material out of the dryer.

In an alternative form, the conveying means includes a conveyor assembly configured to convey the material in substantially one direction so that the material flow path is substantially straight. The inlet is adjacent to a receiving end of the belt, and the outlet is adjacent to a delivery end of the belt.

The agitating means advantageously includes a rotary agitator positioned adjacent to one of the belts. The agitator is configured for agitating the material while the material is conveyed along the path. By agitating the material, the exposure of the material to the infrared radiant energy is increased.

The convection means preferably includes a recirculation duct assembly having a recirculation fan, and a recirculation duct with an inlet in open communication with the interior, and a vent adjacent to the material flow path. The recirculation fan is operably coupled with the recirculation duct so that gas is drawn from the interior of the dryer into the recirculation duct, and directed onto the material while the material is conveyed along the path.

The exhaust means includes an exhaust fan coupled with an exhaust outlet through the structure. The exhaust fan is configured Co draw a quantity of a mixture of the gas and a vapor released by the material from the dryer. The material inlet is configured to allow fresh gas to be drawn into the dryer, replacing the exhausted mixture, and reducing the moisture content of the remaining gas.

DESCRIPTION OF THE DRAWING FIGURES

DETAILED DESCRIPTION OF THE PREFERRED EMBODIMENT

Figure 1:
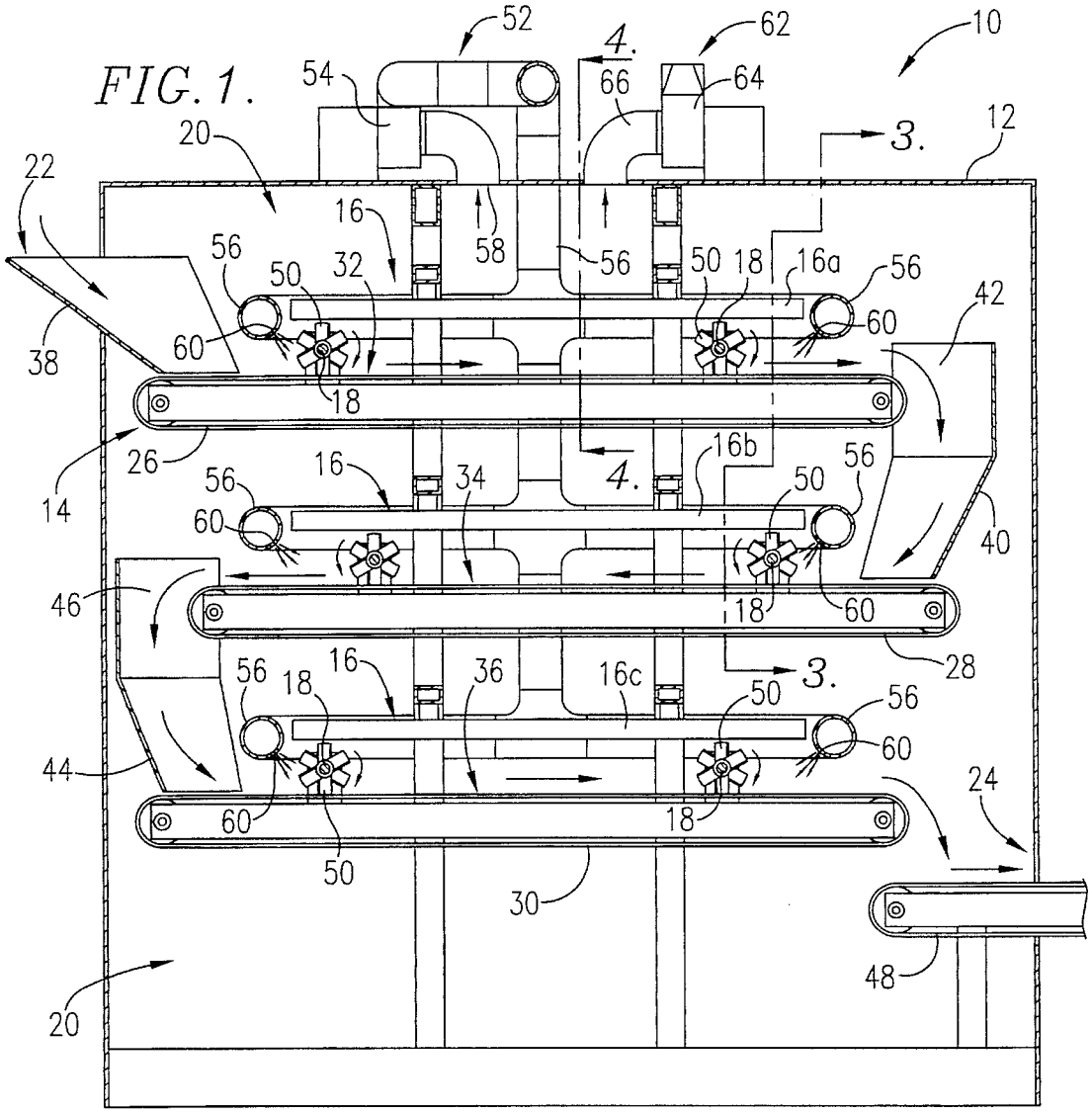
FIG. 1 is a fragmentary, partial vertical section of an infrared wood product dryer constructed in accordance with a preferred embodiment of the present invention illustrating the preferred conveyor assembly.
Figure 4:
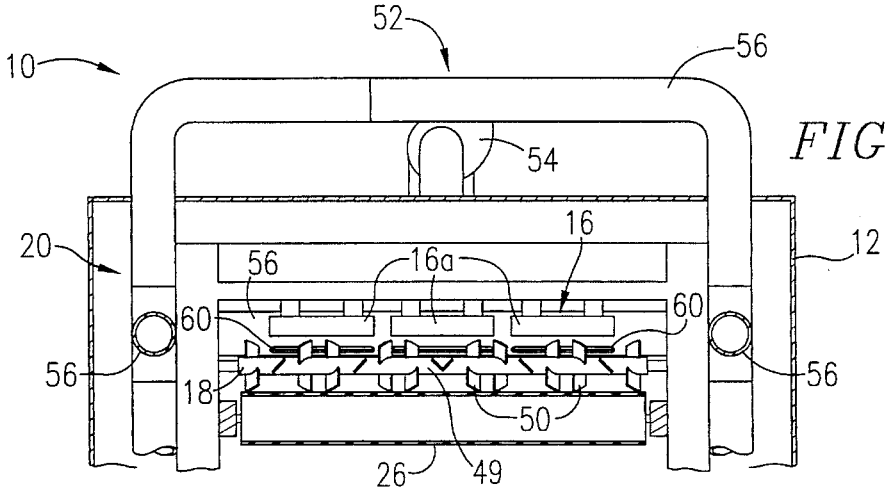
FIG. 4 is a sectional view taken along line 4—4 of FIG. 1.
Figure 2:
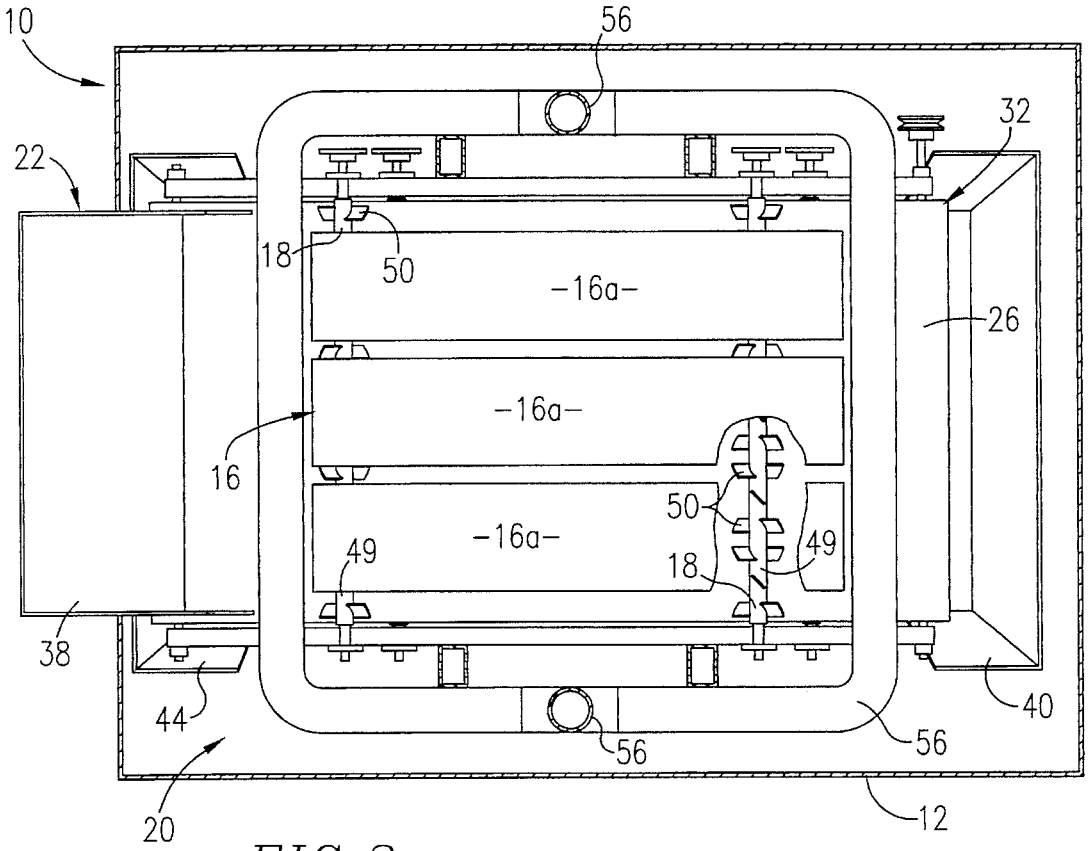
FIG. 2 is a fragmentary view in horizontal section with parts broken away of the dryer of FIG. 1 illustrating the material inlet, and the agitators.
Figure 3:
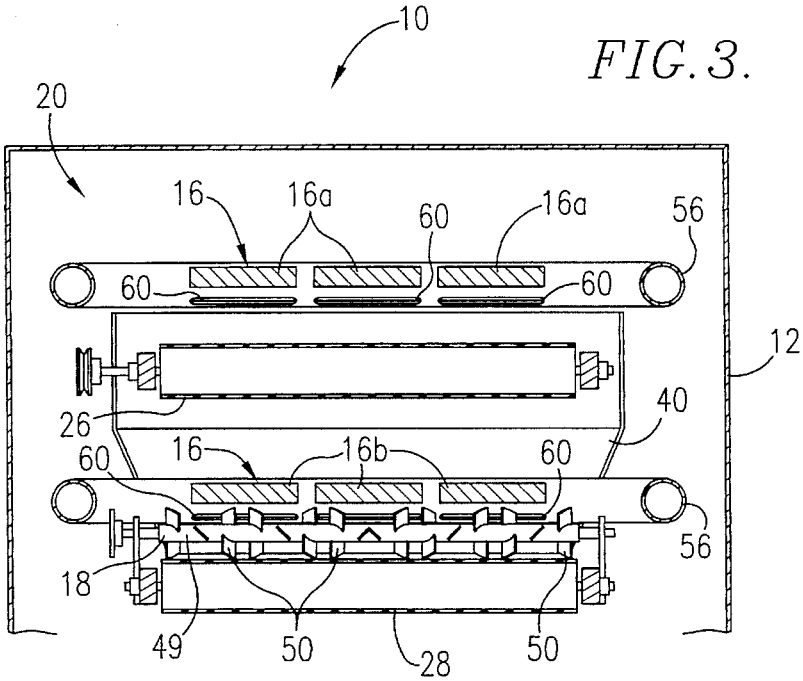
FIG. 3 is a sectional view taken along line 3—3 of FIG. 1.

Referring now to FIG. 1, preferred dryer 10 constructed in accordance with the invention is illustrated. Dryer 10 is configured for drying a continuous stream of a particulate cellulosic material (not shown), such as sawdust, wood chips, and the like. In broad terms, dryer 10 includes enclosure structure 12, conveyor assembly 14, infrared (IR) radiant energy sources 16, and rotary agitators 18. Enclosure structure 12, which is preferably constructed of metal walls, presents interior 20, and includes upper material inlet 22, and lower material outlet 24.

Conveyor assembly 14 is provided within interior 20 as a means for conveying the material between inlet 22 and outlet 24. Assembly 14 includes upper conveyor belt 26, intermediate conveyor belt 28, and lower conveyor belt 30. Upper belt 26 is configured to convey the material along upper material flow path level 32. Intermediate belt 28 is configured to convey the material along intermediate material flow path level 34 in a direction generally opposite to the direction belt 26 conveys the material. Lower belt 30 is configured to convey the material along lower material flow path level 36 in generally the same direction as belt 26.

Receiving chute 38 is provided adjacent to inlet 22. Chute 38 directs the material received through inlet 22 onto belt 26. Upper transfer chute 40 is provided between upper belt 26 and intermediate belt 28. Chute 40 directs material onto belt 28 after the material falls off of the end of belt 26, shown at 42. Lower transfer chute 44 is provided between intermediate belt 28 and lower belt 30. Chute 44 directs the material onto belt 30 after it falls off the end of belt 28, shown at 46. It will be appreciated that belts 26, 28, and 30, and chutes 40, and 44 cooperably convey the material along a substantially serpentine material flow path through interior 20.

Material removal conveyor belt 48 extends through outlet 24, and is configured to convey the material out of dryer 10 through outlet 24. Belts 26, 28, 30, and 48 are preferably constructed of a flexible synthetic resin material. They may, of course, be constructed of other flexible material, or linked metal. Assembly 14 and belt 48 are operably coupled with a motor source (not shown) for driving belts 26, 28, 30, and 48.

Arrays of IR sources 16 (referred to as arrays 16*a*, 16*b*, and 16*c*) are positioned above belts 26, 28, and 30 as a means of exposing the material to IR radiant energy during the conveying of the material along the flow path. IR sources 16 are flameless catalytic gas fired infrared heaters, such as those available from Catalytic Industrial Group, Inc. of Independence, Kans., and shown in the document entitled "Flameless Catalytic Gas Fired Infra-Red Heaters: Technical Bulletin," incorporated herein by reference.

Sources 16 include a preheating element (not shown) and a catalyst bed (not shown). The preheating element is configured to preheat the catalyst bed to a minimum operating temperature, such as approximately 250°–350° F. Once the minimum operating temperature is reached, a fuel gas such as methane is dispensed from a fuel gas supply (not shown) to the catalyst bed. The fuel gas oxidizes once it reaches the catalyst bed, resulting in catalytic combustion.

The catalytic combustion produces water vapor, carbon dioxide, and emits IR radiant energy. The wavelength of the emission is between about 0.5–12 microns. Preferably, the operating temperature of the catalyst bed is between about 700°–900° F. where the emission wavelength is between about 3–7 microns. It will be appreciated that such an emission wavelength is substantially similar to the absorption spectrum of the material, and the moisture within the material.

Sources 16*a*, 16*b*, and 16*c* are positioned approximately 3–12" from corresponding material flow path levels 32, 34, and 36. As a result, there is no appreciable loss of the energy of the IR emission between sources 16 and the flow path.

Agitators 18 are rotatably mounted adjacent to belts 26, 28 and 30 as a means for agitating the material to increase the exposure of the material to the IR radiant energy. Agitators 18 are operably coupled with a motor source (not shown) for rotating agitators 18.

Each of agitators 18 includes an elongated shaft 49 defining an axis of rotation. The axis of rotation is substantially perpendicular to the direction of conveyance. Agitators 18 also include radially extending projections 50. Each of agitators 18 is configured to rotate so that projections 50 contact the material in a direction opposite to the direction of conveyance, thereby agitating and stirring the material.

The material is also agitated as it falls off of the end of belt 26 and slides down chute 40 onto belt 28, shown at 42. The material is similarly agitated as it falls off of belt 28 and slides down chute 44 onto belt 30, shown at 46. Therefore, chutes 40 and 44 also provide a means of agitating the material during the conveyance of the material along the flow path.

Recirculation assembly 52 is provided as a means for directing gas within interior 20 onto the material as it is conveyed along the flow path. Assembly 52 includes recirculation fan 54, and recirculation duct 56 having gas inlet 58, and vents 60. Fan 54 and duct 56 are operably coupled so that fan 54 draws gas from interior 20 through inlet 58, into duct 56, and out of vents 60. As the gas is blown out of vents 60, it is directed onto the material being conveyed along the path.

As the material is dried, it releases vapor. Directing the gas onto the material assists in moving the vapor away from the material, and thus reduces the time necessary for drying.

In addition to emitting IR radiant energy, the sources 16 act to heat the gas within interior 20. For example, some of the IR radiant energy absorbed by the material and the moisture is re-emitted, heating the interior gas. As a result, the interior gas which is recirculated and directed onto the material through vents 60 is heated, causing the material to be convection dried in addition to being dried by the absorption of the IR radiant energy.

Exhaust assembly 62 includes exhaust fan 64, and exhaust port 66. Exhaust port 66 is in open communication with interior 20. Exhaust fan 64 is operably coupled with port 66, and provides a means for exhausting a quantity of the vapor released by the material. For example, as the vapor is released from the drying material, the vapor mixes with the interior gas. A quantity of this mixture is then exhaust from dryer 10 by fan 64. As fan 64 exhausts the mixture, fresh gas is drawn into interior 20 through inlet 22. Since the moisture content of the fresh gas is lower than the exhausted gas, the overall moisture content of the gas in interior 20 is reduced. Although exhaust assembly 62 is shown as being mounted atop enclosure structure 12, it is noted that assembly 62 may also be mounted along the side or bottom of structure 12.

In operation, pre-heating elements are activated which pre-heat the catalyst bed to a temperature which is sufficient to support catalytic combustion, such as approximately 250°–350° F. Once this temperature is reached, the fuel gas is distributed to the catalyst bed, resulting in catalytic combustion and IR radiant energy emission, and a stream of the particulate cellulose material is fed into dryer 10 through inlet 22.

As the material is conveyed by upper conveyor belt 26 along upper material flow path level 32, it is exposed to upper array 16*a* of sources 16. A pair of agitators 18 agitates the material, and increases the exposure of the material to IR radiant energy. It will be appreciated that agitating the material while the material is conveyed along the path increases the exposure of the material to the IR radiant energy.

Once the material reaches the end of level 32, it falls, and is directed onto belt 28 by chute 40, shown at 42. It will be appreciated that the material is agitated as it falls onto belt 28. The exposure and agitation of the material is continued along flow path levels 34 and 36.

Recirculation assembly 52 causes the heated gas to be directed onto the material adjacent to vents 60. The combination of IR radiant energy and heated gas acts to dry the material as the material is conveyed along the path.

As the material is dried, it releases vapor which mixes with the interior gas, increasing the moisture content of the gas. The moisture content of the interior gas is further increased by the release of water vapor from the catalytic combustion. As the moisture content increases, the drying effectiveness of dryer 10 decreases. Exhaust fan 64 is then used to exhaust a quantity of the interior gas from interior 20, causing fresh gas to be drawn into interior 20, reducing the moisture content of the gas. It will be appreciated that reducing the moisture content of the interior gas allows the material to be dried more rapidly and efficiently.

The material also releases volatile organic compounds (VOCs), such as terpene, as it is dried. Since VOCs can be harmful to the environment, reduction of the VOC level of the exhaust gas may be desired.

It will be appreciated that sources 16 and exhaust assembly 62 cooperably reduce the VOC level of the exhausted gas. For example, VOCs oxidize in the presence of the catalyst beds of sources 16. Since exhaust port 66 is positioned above sources 16, exhaust fan 64 draws the interior gas past the catalyst beds of sources 16, and thus promotes catalytic combustion of the VOCs. As the oxidation reaction associated with catalytic combustion causes the destruction of some of the VOCs, the VOC level of the gas released into the atmosphere is reduced.

Once the material reaches the end of the material flow path, the material is deposited onto removal belt 48. Belt 48 conveys the dried material through outlet 24, and the material is ready for use.

Although the present invention has been described with reference to the illustrated preferred embodiment, it is noted that variations and changes may be made, and equivalents employed without departing from the scope of the invention as set forth in the claims.

Rotary agitators 18 are shown as a means for agitating the material during the conveying of the material along the flow path. Other means of agitating the material may be employed. For example, gas may be recirculated and blown from underneath the material. Using gas to agitate the material would also provide a means for convection drying the material.

IR radiant energy sources 16 are flameless catalytic gas-fired heaters. Non-catalytic and electrically powered heating elements may also be used. For example, high temperature gas infrared heaters, or other types of gas infrared heaters may be used as a source of infrared radiant energy. Additionally, an infrared lamp could be used.

What is claimed is:

1. A method of drying a particulate moisture-bearing material comprising the steps of:

conveying a particulate material along a material flow path;

exposing the material to infrared radiant energy from a flameless catalytic gas-fired heater during said conveyance along said path, said heater operating at a temperature of from about 700°–900° F., said infrared radiant energy having a wavelength similar to the absorption spectrum of said material and the moisture therein to enhance drying of the material; and agitating the material during said conveyance along said path.

2. The method of claim 1, said particulate material being cellulosic material.

3. An infrared radiant energy dryer for drying particulate material comprising:

a material inlet configured for receiving a continuous stream of a particulate material;

a material outlet;

conveying means for conveying the particulate material along a material flow path between said inlet and said outlet;

means including an infrared radiant energy source for exposing the particulate material to infrared radiant energy during said conveyance along said path; and agitating means for agitating the particulate material during said conveyance along said path, for increasing the exposure of the particulate material to said infrared radiant energy, wherein said agitating means includes an elongated rotary agitator positioned adjacent to said conveying means.

4. An infrared radiant energy dryer for drying particulate moisture-bearing material comprising:

a material inlet configured for receiving a continuous stream of a particulate material;

a material outlet;

conveying means for conveying the particulate material along a material flow path between said inlet and said outlet;

means including an infrared radiant energy source for exposing the particulate material to infrared radiant energy during said conveyance along said path, said energy source comprising a flameless catalytic gas-fired heater operating at a temperature of from about 700°–900° F., said infrared radiant energy having a wavelength similar to the absorption spectrum of said material and the moisture therein to enhance drying of the material; and agitating means for agitating the particulate material during said conveyance along said path, for increasing the exposure of the particulate material to said infrared radiant energy.

5. An infrared radiant energy dryer for drying particulate moisture-bearing material comprising:

a material inlet configured for receiving a continuous stream of a particulate material;

a material outlet;

conveying means for conveying the particulate material along a material flow path between said inlet and said outlet;

means including an infrared radiant energy source for exposing the particulate material to infrared radiant energy during said conveyance along said path, said source emitting infrared radiant energy having a wavelength between about 3–7 microns, said wavelength being similar to the absorption spectrum of said particulate material and the moisture therein to enhance drying of the particulate material; and agitating means for agitating the particulate material during said conveyance along said path, for increasing the exposure of the particulate material to said infrared radiant energy.

6. The dryer as set forth in claim 1, wherein said conveying means includes a conveyor assembly having a plurality of superposed conveyor belts, each belt defining a separate material path level, and adjacent ones of said conveyor belts being configured to convey the material in opposite directions.

7. The dryer as set forth in claim 6, wherein said inlet is adjacent to an upper one of said conveyor belts, said outlet is adjacent a lower one of said conveyor belts, and said material flow path is substantially serpentine.

8. The dryer as set forth in claim 1, wherein said conveying means includes a conveyor assembly having at least one conveyor belt, said belt being configured for conveying the material in substantially one direction.

9. The dryer as set forth in claim 1, wherein said source is a flameless catalytic gas-fired heater.

10. The dryer as set forth in claim 9, wherein said heater includes a catalyst bed which operates at a temperature of between about 700°–900° F.

11. The dryer as set forth in claim 1, further including convection means for directing an interior gas onto the particulate material during said conveyance along said path.

12. The dryer as set forth in claim 11, further including structure defining an enclosure defining an interior, and said convection means includes a recirculation assembly having a recirculation fan, and a recirculation duct with an inlet in open communication with the interior, and a vent adjacent said material flow path, said recirculation fan being operably coupled with said duct so that the interior gas is drawn into said duct, and directed onto the material during said conveying along said material flow path.

13. The dryer as set forth in claim 1, further including exhaust means for exhausting from said interior a quantity of a vapor released from the material.

14. The dryer as set forth in claim 1, wherein said agitating means includes an elongated rotary agitator positioned adjacent to said conveying means.

15. A method of drying a particulate moisture-bearing material comprising the steps of:

conveying a particulate material along a material flow path;

exposing the material to infrared radiant energy having a wavelength of between about 3–7 microns during said conveyance along said path, said wavelength being similar to the absorption spectrum of said particulate material and the moisture therein to enhance drying of the particulate material; and agitating the material during said conveyance along said path.

16. The method as set forth in claim 15, further including the step of directing a heated gas on the material during said conveyance along said path.

17. The method of claim 15, said particulate material being cellulosic material.

* * * * *